US005174074A

United States Patent [19]

Dyken

[11] Patent Number: 5,174,074

[45] Date of Patent: Dec. 29, 1992

[54] ASSEMBLY FOR CASTING LARGE CURVED SHELLS OF REINFORCED CONCRETE

[75] Inventor: Tormod O. Dyken, Tranby, Norway

[73] Assignee: Norwegian Contractors a.s., Stabekk, Norway

[21] Appl. No.: 727,271

[22] Filed: Jul. 9, 1991

[30] Foreign Application Priority Data

Jul. 11, 1990 [NO] Norway ..... 903093

[51] Int. Cl.[5] ..... E04B 1/16; E04B 7/14

[52] U.S. Cl. ..... 52/80; 52/83; 249/127; 249/205; 264/31

[58] Field of Search ..... 52/2.15, 83, 80, 329, 52/330, 335, 339; 249/12, 18, 20, 28, 127, 205, 219.1; 264/31, 313

[56] References Cited

U.S. PATENT DOCUMENTS

| | | | |
|---|---|---|---|
| 1,411,446 | 4/1922 | Martin | 52/83 X |
| 2,232,439 | 2/1941 | Connor | 52/83 X |
| 2,411,651 | 11/1946 | Darby | 52/83 X |
| 2,842,073 | 7/1958 | Huston et al. | 52/80 |
| 3,410,039 | 11/1968 | Brezina | 52/80 |
| 3,590,448 | 7/1971 | Bryant | 52/80 |
| 4,094,110 | 6/1978 | Dickens et al. | 52/80 |

FOREIGN PATENT DOCUMENTS

| | | | |
|---|---|---|---|
| 232244 | 10/1962 | Austria | 52/80 |

*Primary Examiner*—David A. Scherbel
*Assistant Examiner*—Robert Caufield
*Attorney, Agent, or Firm*—Wenderoth, Lind & Ponack

[57] ABSTRACT

A large, curved or spherical shell of reinforced concrete is cast without utilization of supporting framework. A casting formwork is in the form of a thin, suspended membrane that is reinforced with a collar. During construction and transport, the membrane is preliminarily equipped with a reinforcing compression ring.

11 Claims, 3 Drawing Sheets

ASSEMBLY FOR CASTING LARGE CURVED SHELLS OF REINFORCED CONCRETE

BACKGROUND OF THE INVENTION

The present invention relates to a means used in connection with casting of concrete structures, particularly large, curved surfaces of shells, without utilization of supporting framework, and without removal of formwork.

Conventional use of formwork and casting of large, more or less curved surfaces, requires a comprehensive, heavy and costly supporting framework or the like. The operation of assembling and disassembly such structures is substantial and time-consuming, especially when involving the casting of sealing structures in reinforced concrete in connection with large halls or the like, or in connection with spherical shells in offshore structures with tall concrete skirts.

SUMMARY OF THE INVENTION

In accordance with the present invention, a thin suspended membrane is utilized as formwork in connection with casting of large, more or less curved surfaces.

The membrane may be made of steel or other high tension strength material. Alternatively, it can consist of a composite material, such as for instance a meshwork of high tension material imbedded in a matrix, for instance consisting of sprayed concrete or a synthetic material.

The membrane is suitably made in a mold or by using a template, for instance by welding together thin, accurately shaped steel plates or sheets. The plates or sheets can be so thin that they naturally conform to the mold, or they can be preformed. In most cases, a facet shape in one direction will be acceptable, so that the plates for a double-curved surface only need to be single-curved. A termination or border and a marginal reinforcement of the membrane is provided by a collar thereof, made from a somewhat stronger material. Such collar can also serve as support of the membrane and for connection thereof to an already existing structure, to which a new casting will be attached and by which the casting will be supported. The collar either can be attached to the membrane as an integral part thereof, prior to assembly, or it can form a part of the support. The latter alternative will offer possibilities for larger assembly tolerances.

The membrane may, if desired, function as a lost or remaining formwork, which will not be recovered.

BRIEF DESCRIPTION OF THE DRAWINGS

The invention will be described further in the following in connection with the casting of a spherical shell on top of an already made, cast concrete skirt, forming part of a subsea structure during fabrication, and with reference to the accompanying drawings, wherein.

DETAILED DESCRIPTION OF THE INVENTION

Figure 1:
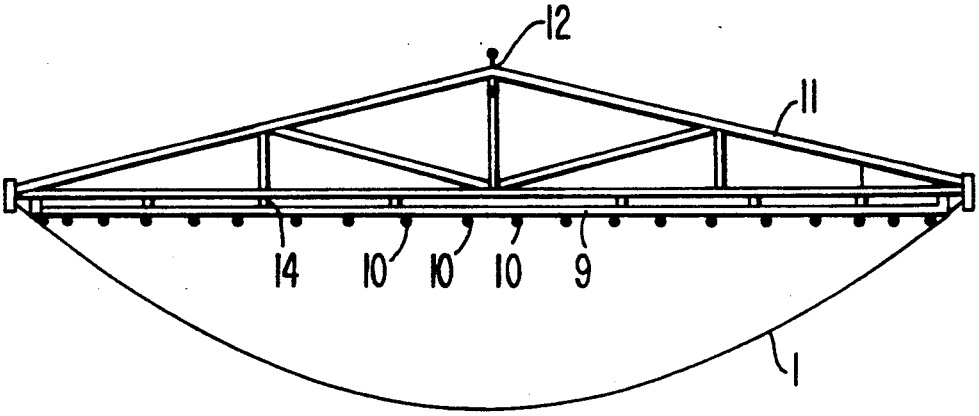
FIG. 1 is an elevation view showing the membrane suspended in a transport yoke.
Figure 5:
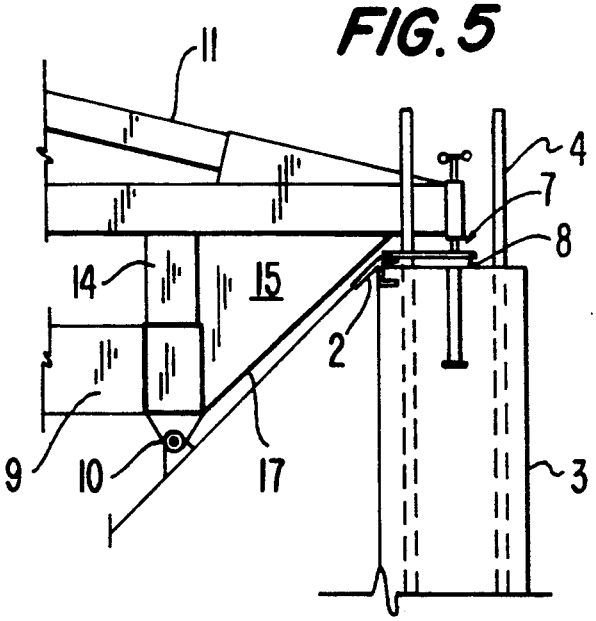
FIG. 5 is a detailed sectional view illustrating a compression ring for supporting of the membrane during transport.

FIG. 1 shows a membrane 1 which is suspended from a compression ring 9 by fixed link connections 10 located close to an outer edge of the membrane (also see FIG. 5). The membrane with attached compression ring 9 is transported in suspended position by hangers 14 fastened to the compression ring and supported by a lightweight yoke or truss 11. In order to relieve forces on the compression ring 9, stiffening straps or plates 15 may be connected to the truss 11 that has a lifting point 12 for support by a crane (not shown). Each strap 15 has a lower outer edge 17.

The membrane 1 is lifted up and suspended into a ready-made support or foundation by means of the crane. The foundation is, in the illustrated arrangement, a concrete wall or skirt 3. A collar 2 provided on the peripheral edge of the membrane is fixed to the top surface of the skirt, e.g. at positions between upwardly extending skirt reinforcements 4. The horizontal force components arising from the support of the membrane are carried by steel elements 7 and plates 8, a suitable number of which are imbedded into the top of the concrete skirt 3.

During assembly, it is desirable that the lifting crane can be released and removed as soon as possible. The compression ring 9 will then temporarily be able to absorb the horizontal load until a sufficient number of steel elements 7 have been attached to the structure.

The membrane defines a large, exposed area. If it is in contact with the sea over a long period of time, a corrosion protectional system and flow draining system can be provided. In such case, the membrane may be isolated from the reinforcement.

Figure 2:
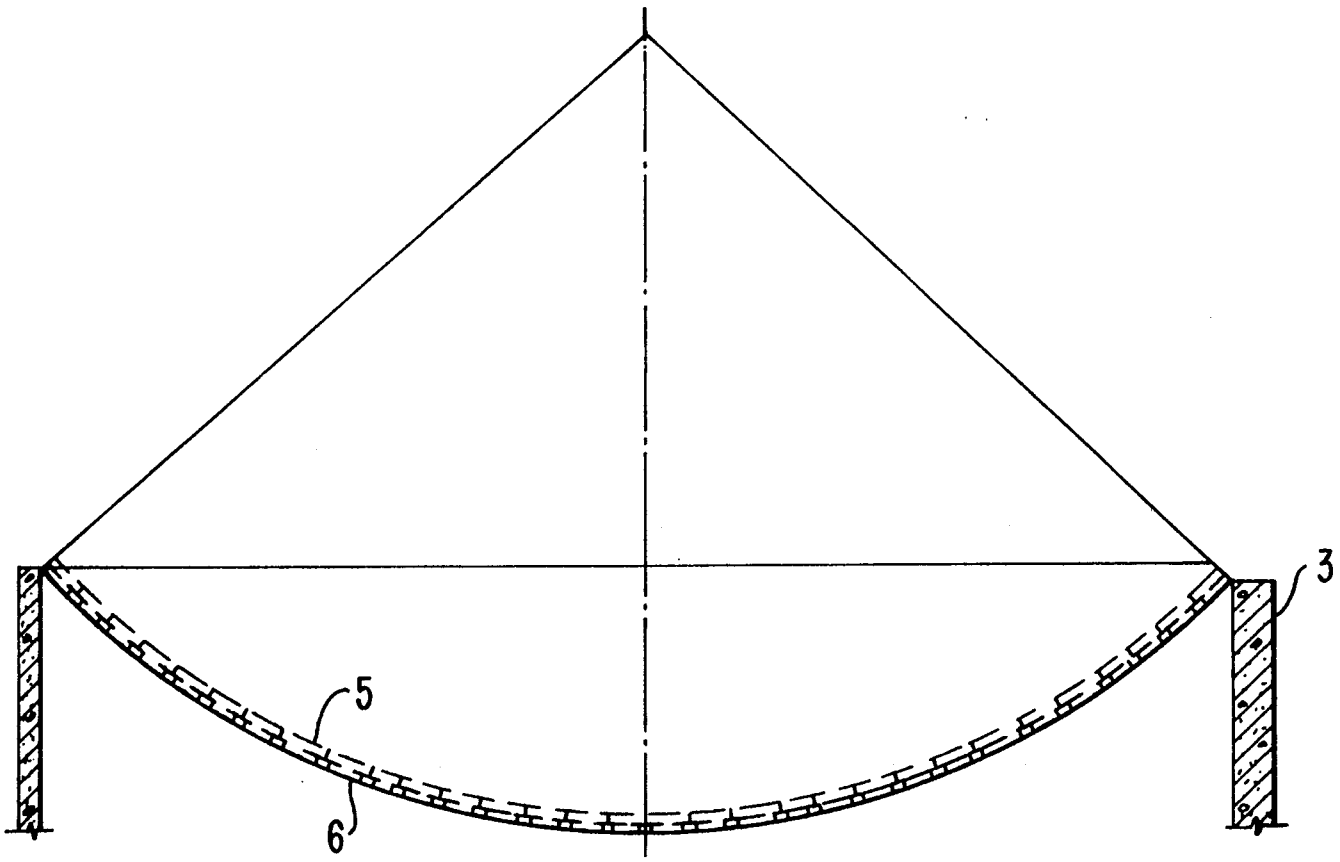
FIG. 2 is a sectional view through the membrane in a suspended position and being supported by a wall or skirt.
Figure 4:
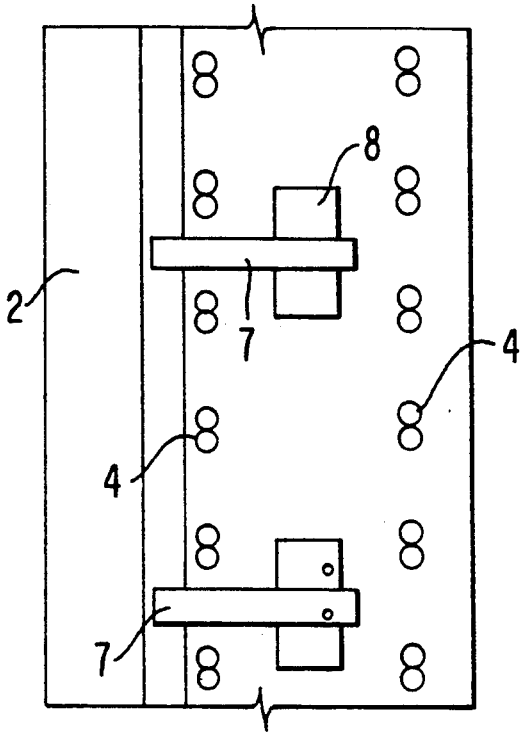
FIG. 4 is a plan view of FIG. 3, illustrating how the membrane can be attached to the support wall.
Figure 3:
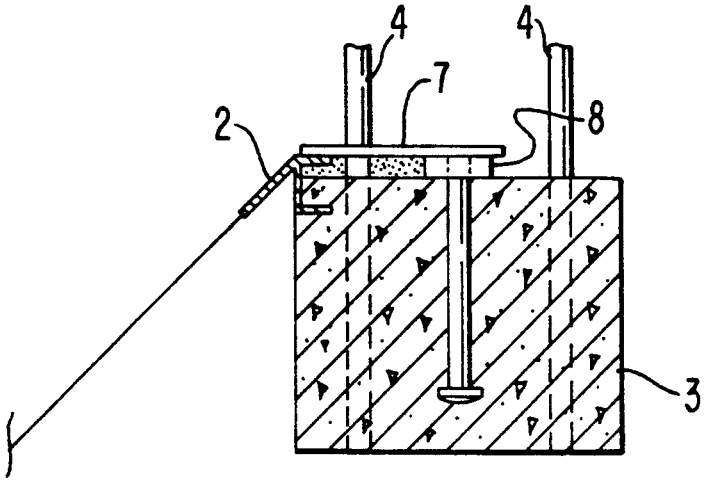
FIG. 3 is a sectional view of a detail of a preferred suspension for the membrane during use.

The apparatus functions in the following manner. The membrane will primarily carry the loads from its own weight, the weight of armoring and the concrete weight, evaluated as a singular axial force. during the molding process, the membrane will, however, by only partly loaded. It will then tend to straighten out along areas which are not being stressed. This is to da certain degree counteracted by the bending stiffness of the membrane as such, and also by the weight of a casting basket or reinforcement 5 that may be positioned to evenly distribute the concrete, as shown in FIG. 2. In addition, a finished armoring attached to the basket will offer a stiffening effect and limit any deformation to an acceptable level. Specific parts of an armored basket may be designed as curved or arched trusses by welding diagonally directed members between steel members in the top mesh of the basket and steel members in the bottom mesh thereof. The armored basket 5 normally will be supported on spacing blocks 6 of concrete, which further rest on the membrane. Since the membrane subjected to load will not expand substantially, and since an inwardly directed displacement will be hindered by the stiffness and weight of the basket, deformations occurring in the membrane will be rather small. If a need in special applications should arise for a still more rigid system, high strength connections can be made between the membrane and the basket 5, or trusses can be attached by welding to the underside of the membrane.

I claim:

1. An assembly for use in casting a large, curved or spherical shell of reinforced concrete without the need for a casting supporting framework, said assembly comprising:

a thin, suspendable membrane having a periphery;

a reinforcing collar connected to said periphery of said membrane and by which said membrane may be mounted on and suspended peripherally from a foundation; and means for, during transportation of said membrane and mounting thereof on the foundation, suspending said membrane, said means comprising a reinforcing compression ring attached to said membrane such that said membrane is suspended therefrom and such that after said membrane is mounted on the foundation said ring may be removed from said membrane.

2. An assembly as claimed in claim 1, wherein said ring is attached to said membrane at a position spaced from said collar.

3. An assembly as claimed in claim 2, wherein said ring is attached to said membrane at a position inwardly of said collar.

4. An assembly as claimed in claim 1, wherein said ring is attached to said membrane by a plurality of link connections depending from said ring.

5. An assembly as claimed in claim 1, wherein said membrane is formed of steel.

6. An assembly as claimed in claim 1, wherein said membrane is formed of a plurality of thin steel sheets connected together.

7. An assembly as claimed in claim 6, wherein said steel sheets are connected by welding.

8. An assembly as claimed in claim 1, wherein said membrane is formed of a composite material.

9. An assembly as claimed in claim 8, wherein said composite material comprises a high strength material embedded in a matrix material.

10. An assembly as claimed in claim 9, wherein said matrix material comprises concrete.

11. An assembly as claimed in claim 9, wherein said matrix material comprises plastic.

* * * * *